US006349846B1

(12) United States Patent
Meza

(10) Patent No.: US 6,349,846 B1
(45) Date of Patent: Feb. 26, 2002

(54) FOLD UP INSULATED BEVERAGE HOLDER HAVING A LID

(76) Inventor: Robert B. Meza, 5602 Old Brownsville Rd., Corpus Christi, TX (US) 78417

( * ) Notice: Subject to any disclaimer, the term of this patent is extended or adjusted under 35 U.S.C. 154(b) by 0 days.

(21) Appl. No.: 09/745,238

(22) Filed: Dec. 22, 2000

(51) Int. Cl.[7] ..... B65D 25/34

(52) U.S. Cl. ..... 220/739; 220/740; 220/212

(58) Field of Search ..... 220/903, 739, 220/740, 742, 737, 380, 375, 212, 831, 832, 847

(56) References Cited

U.S. PATENT DOCUMENTS

| | | | | |
|---|---|---|---|---|
| 3,905,511 A | | 9/1975 | Groendal | |
| 4,194,627 A | | 3/1980 | Christensen | |
| 4,273,216 A | * | 6/1981 | Weissmann | |
| 4,648,525 A | | 3/1987 | Henderson | |
| 4,690,300 A | * | 9/1987 | Woods | 220/903 |
| 4,872,577 A | | 10/1989 | Smith | |
| 5,048,734 A | | 9/1991 | Long | |
| 5,169,025 A | | 12/1992 | Guo | |
| 5,186,350 A | | 2/1993 | McBride | |
| 5,261,554 A | | 11/1993 | Forbes | |
| 5,564,583 A | * | 10/1996 | Kelley et al. | 220/903 |
| 5,740,940 A | | 4/1998 | Weis | |
| 5,740,951 A | | 4/1998 | Jack | |
| 5,765,712 A | | 6/1998 | Skinner | |
| 5,845,806 A | | 12/1998 | Parchman | |

* cited by examiner

*Primary Examiner*—Stephen Castellano
(74) *Attorney, Agent, or Firm*—G Turner Moller

(57) ABSTRACT

An insulated beverage holder is made of a bodily flexible foam material having a sleeve for receiving a beverage container and a lid. The lid is attached to the sleeve and is movable from a position covering the open top of a beverage container to a position away from the sleeve. The sleeve may be folded into a stowed position inside the lid. Fasteners are provided to keep the folded sleeve inside the lid and provide a compact decorative package.

19 Claims, 2 Drawing Sheets

FOLD UP INSULATED BEVERAGE HOLDER HAVING A LID

This invention relates to an insulated beverage holder and, more particularly, to such a device which has a lid and which may be folded up for transport or storage.

BACKGROUND OF THE INVENTION

Insulated beverage holders are well known in the art for receiving beverage cans or bottles and insulating the contents thereof from rapid temperature change. The standard insulated beverage holder of the prior art is made of a bodily flexible foam material with a fabric covering and has a circular bottom wall connected to a cylindrical side wall. The standard insulated beverage holder occupies somewhat more than the volume of the container which it is designed to hold, thereby making it inconvenient to ship, display for sale or store between uses. When empty, the standard insulated beverage holder will stand upright and neither tip over nor will the cylindrical side wall collapse or flex from its own weight.

The standard insulated beverage holder has an open top so the top of the container therein is exposed. There is accordingly considerable heat loss through the exposed top of the container. In addition, openings in the top of the container allow entry of dust, insects and the like. Thus, bees or the like are attracted to sweet liquids in the container and are known to fly into the openings of containers held in standard insulated beverage holders to the consternation of a person drinking from the container. In very dusty situations, a close inspection of the container contents will ruin one's inclination to drink from the container.

Of some interest relative to this invention are the disclosures in U.S. Pat. Nos. 3,905,511; 4,194,627; 4,648,525; 4,875,577; 5,048,734; 5,169,025; 5,186,350; 5,261,554; 5,740,940; 5,740,951; 5,765,712 and 5,845,806.

SUMMARY OF THE INVENTION

In this invention, an insulated beverage holder includes a cylindrical sleeve for receiving a beverage container and a lid. The lid is pivoted to move from a position covering the top of a container received in the holder and a position away from the container top. The lid does double duty and provides a receptacle where the holder sleeve is folded up and stowed during transport, display and non-use. Suitable releasable fasteners, such as hook-and-loop fasteners, secure the sleeve in the lid in the stowed position and secure the sleeve in a position where it does not flop over toward the container top when the user is drinking from the container.

It is accordingly an object of this invention to provide an improved insulated beverage holder.

Another object of this invention is to provide an improved insulated beverage holder having a lid.

A further object of this invention is to provide an improved insulated beverage holder where a lid provides a receptacle for temporarily receiving the holder sleeve during transport, display and/or non-use.

These and other objects and advantages of this invention will become more fully apparent as this description proceeds, reference being made to the accompanying drawings and appended claims.

DETAILED DESCRIPTION

Referring to FIGS. 1–4, an insulated beverage holder 10 of this invention comprises, as major components, a sleeve 12 for receiving a conventional beverage container 14 and a lid 16 for selectively covering the top of the beverage container 14. The insulated beverage holder 10 is made of any suitable material such as a foam having a fabric covering on the inside and out. Such materials are well known in the art and are commercially available.

Figure 1:
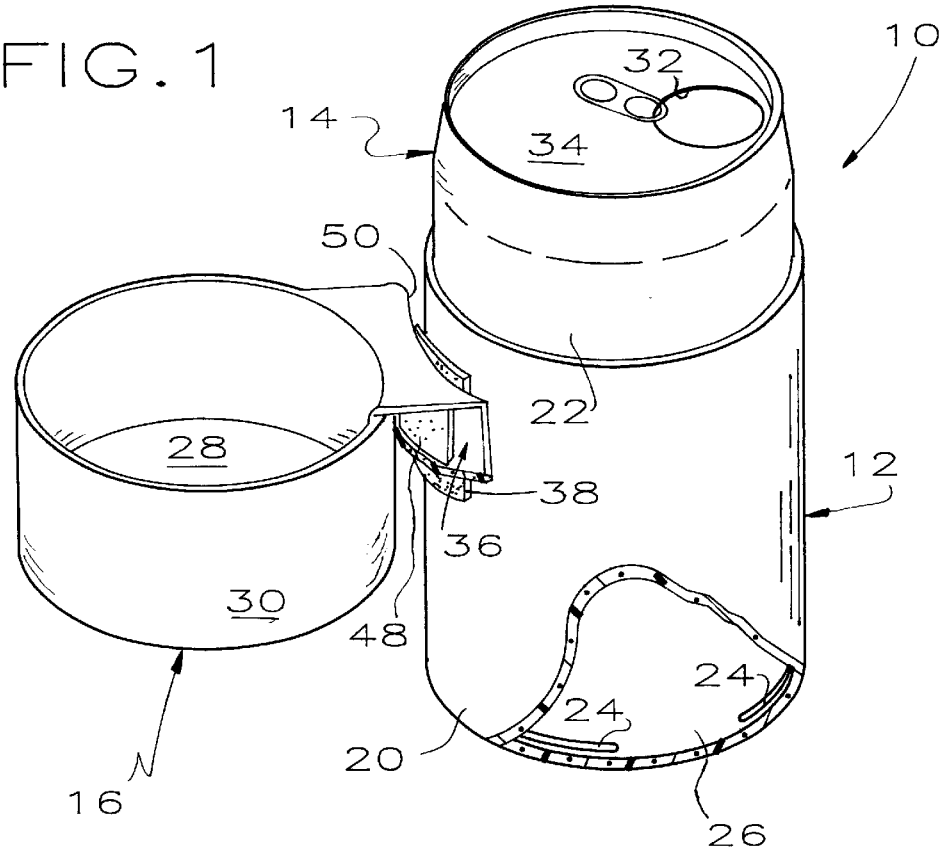
FIG. 1 is an isometric view of an insulated beverage holder of this invention, showing a lid in an offset position allowing a user to drink from a container, certain parts being broken a or clarity of illustration.
Figure 2:
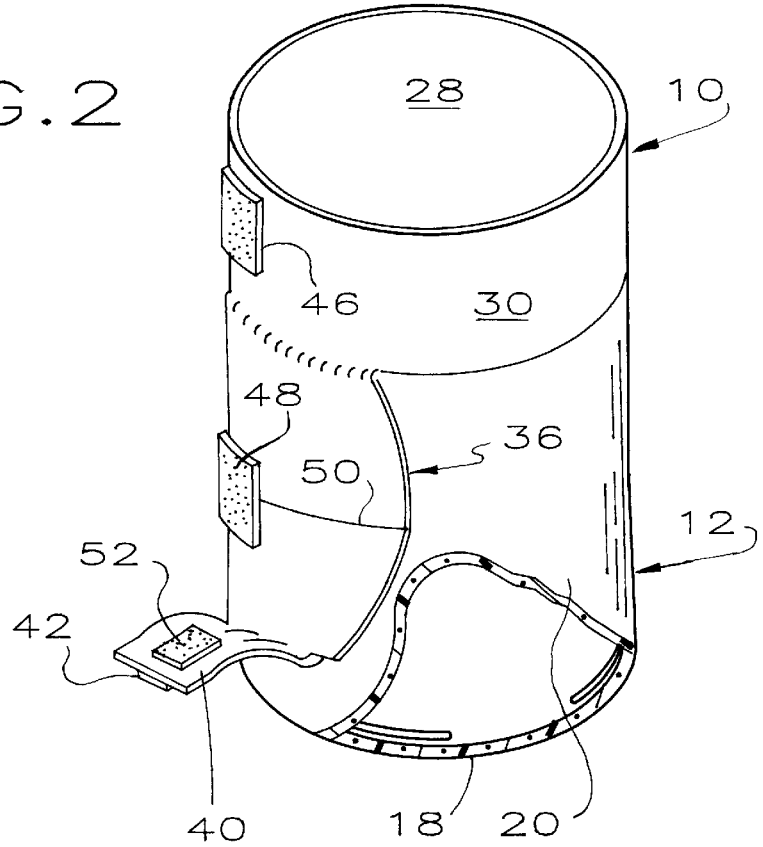
FIG. 2 is another isometric view of the insulated beverage holder of this invention showing a container received in the holder and a lid covering the container.

The sleeve 12 is of cylindrical shape having a bottom wall 18 and a cylindrical side wall 20 of a size to fit snugly over the outside of the beverage container 14, which is typically a standard sized can but which may be a bottle, large sized can or the like. It will be seen that the lid 16 is coaxial with the sleeve 12 in the protected configuration of the lid, as shown in FIG. 2. The sleeve 12 is of a conventional height to expose an upper portion 22 of the beverage container 14, as shown in FIG. 1, so the user can easily drink from the container 14. For purposes more fully explained hereinafter, the bottom wall 18 is quite flexible relative to the side wall 20. To this end, the bottom wall 18 is slit along part of the junction with the side wall 20 along slots 24, leaving a pair of diametrically opposed connecting areas 26. A device with this type bottom is well known in the prior art and is often referred to as a caddy as opposed to a holder.

The lid 16 includes a flat section 28 and a lip 30 which is cylindrical to match the size and shape of the sleeve 12 so it easily fits over the upper portion 22 of the beverage container 14 thereby minimizing heat loss from the beverage container 14, preventing bees and the like from entering the container 14 through the opening 32 in the top wall 34 thereof and keeping airborne dust, pollen and the like from entering the container opening 32.

Figure 4:
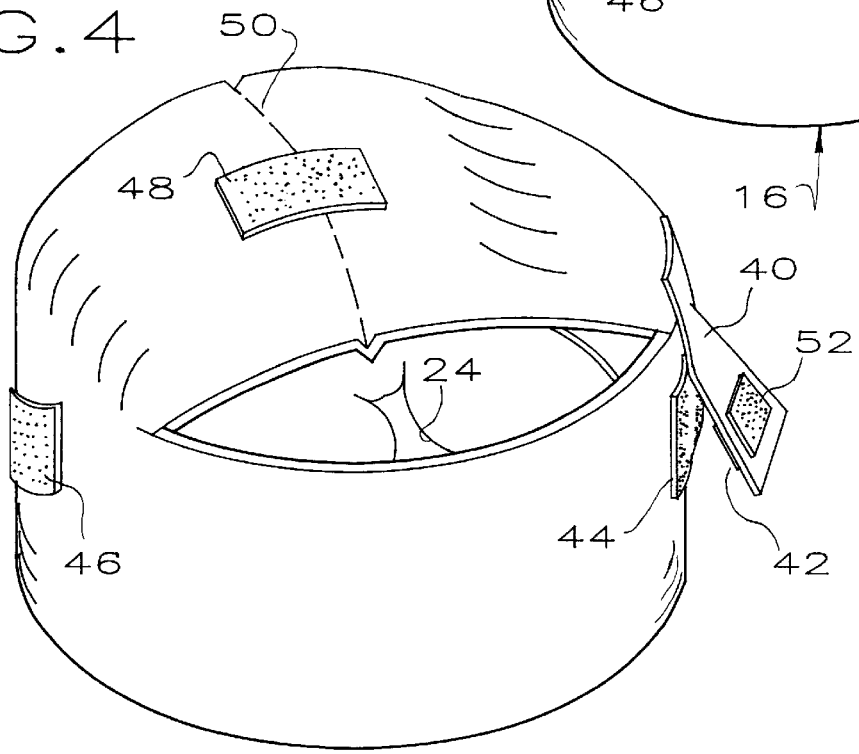
FIG. 4 is an isometric view of the insulated beverage holder of this invention in a stowed position.

The lid 16 is connected to the sleeve 12 by a flap 36 connected in any suitable manner to the sleeve side wall 20, as by a hook-and-loop patch 38 secured to the side wall 20, by one or more rows of stitching (not shown) or the like. The lid 16 has an additional purpose which is to provide a receptacle for the sleeve 12 when the beverage holder 10 is not in use. To this end, the lip 30 of the lid 16 is somewhat deeper than might be expected because the lid 16 houses the sleeve 12, in a folded up configuration, as shown in FIG. 4. The flap 36 may be cut from the same stock as the lip 16 or may be sewn or otherwise attached to the lip 16 in any suitable manner. The flap 36 preferably includes a generally circular section to close the opening in the lid 16 as shown best in FIG. 4.

Figure 3:
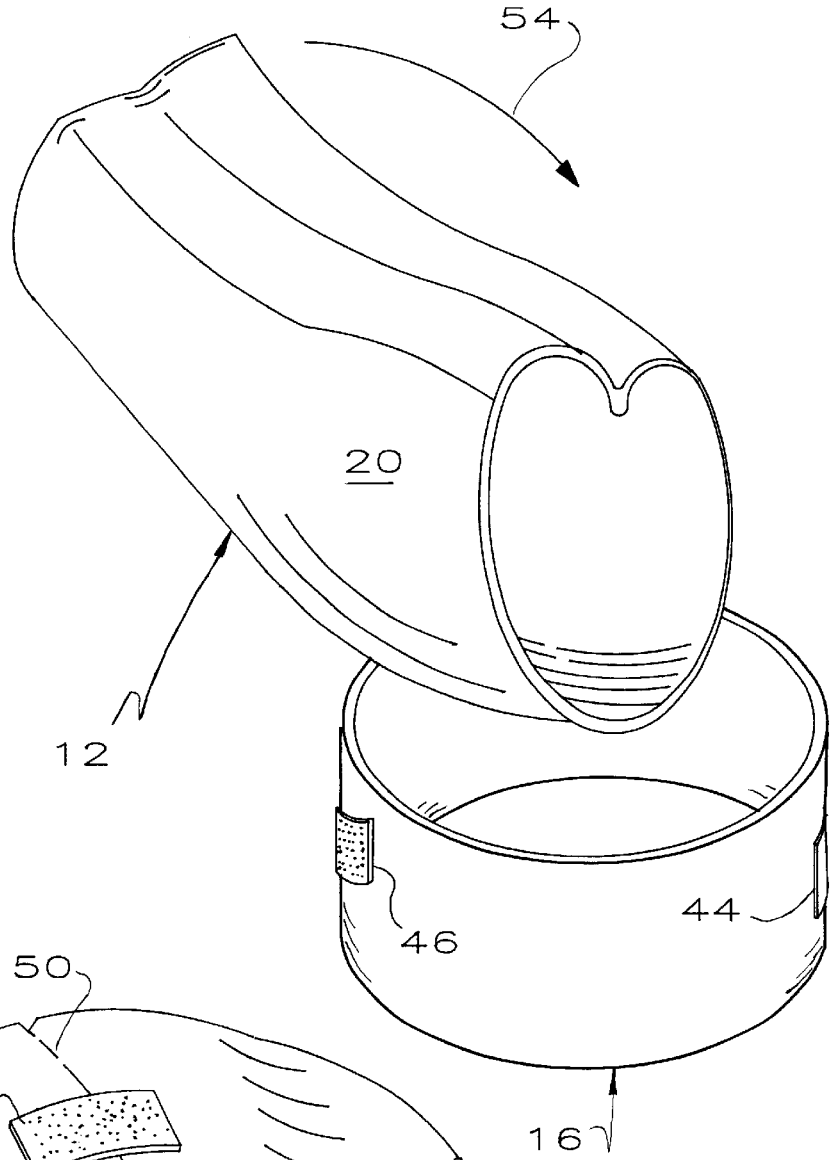
FIG. 3 is another isometric view of the insulated beverage holder of this invention showing the holder sleeve in a partially folded up position, about to be inserted into the lid.

Because the lid 16 houses the sleeve 12 in the configuration shown in FIG. 4, it is desirable to secure the flap 36 in a stowed position of the sleeve 12. To this end, the flap 36 provides a tab 40 having a suitable fastener 42 for connection to a mating fastener 44 on the outside of the lip 16, as shown in FIGS. 3 and 4. Although the fasteners 42, 44 may be of any suitable type, a conventional hook-and-loop type arrangement is preferred. It will be seen from FIG. 4 that the flap 36 closes the lip 16, in the stowed position of the sleeve 12, thereby preventing movement of the sleeve 12 out of the lid 16. Preferably, but not necessarily, the flap 36 is of the same size as the opening of the lid lip 16 so the sleeve 12 is concealed in the stowed configuration of FIG. 4.

Because the flap 36 is easily pivoted on the sleeve 12, there is some tendency for the flap 36 to oscillate toward and away from the user when drinking from the container 14, which can be distracting. If this is considered a problem, the flap 36 can be partially immobilized by providing a second set of fasteners 46, 48 on the lip 30 and on the flap 36. In the offset position of the lid, as when drinking from the container, the tab 40 is folded against the lid 16 and a fastener 52 on the tab 40 is connected to the fastener 48. The lid 16 is folded downwardly so the fasteners 42, 46 connect. Because the fastener 48 spans the fold 50 or pivot axis of the flap 36, there is much less of a tendency of the flap 36 to pivot with the fasteners 46, 48 connected together. In addition, by placing the tab 40 between the lid lip 30 and the cylindrical sidewall 20, the tab 40 is out of the way. Although the fasteners 46, 48 may be of any suitable type, a conventional hook-and-loop type fastener is preferred.

Use of the insulated beverage container 10 should now be apparent. From the stowed position of FIG. 4, the tab 40 is disconnected from the lip 30 by separating the fasteners 42, 44. By pulling on the flap 36, the sleeve 12 is withdrawn from inside the lid 16. The sleeve 12 may be opened and the beverage container 14 inserted therein. The lid 16 may be placed over the upper portion 22 of the beverage container 10 to prevent dust, bees and the like from entering the container opening 32. When it is desired to drink from the container 14, the lid 16 is pivoted to the offset position shown in FIG. 1. If the lid 16 tends to flap too much to suit the user, the lid 16 may be partially immobilized by connecting the fasteners 48, 52 and then the fasteners 42, 46. In the alternative, the lid 16 may be connected directly to the flap 36 by joining the fasteners 46, 48 thereby leaving the tab 40 to dangle.

To stow the beverage container 10, the sleeve 12 is folded as shown in FIG. 3 so the side wall 20 is creased down the middle and then folded end-over-end as suggested by the arrow 54 in FIG. 3 so the sleeve 12 is easily folded up to fit inside the lid 16. The flap 36 is folded over the opening to the lid 16 and the tab 40 connects to the fastener 44 as shown in FIG. 4 to provide a stowed or non-use configuration.

Although this invention has been disclosed and described in its preferred forms with a certain degree of particularity, it is understood that the present disclosure of the preferred forms is only by way of example and that numerous changes in the details of operation and in the combination and arrangement of parts may be resorted to without departing from the spirit and scope of the invention as hereinafter claimed.

I claim:

1. An insulated beverage holder comprising a first container surrounding section made of a thermally insulating material having a tubular side wall for receiving a first portion of a beverage container and a central portion spanning one end of the side wall, and a second container surrounding section made of a thermally insulating material having a tubular skirt parallel to the side wall for receiving a second portion of the container and a central portion spanning one end of the skirt, the first container surrounding section being collapsed in a stowed position inside the second container surrounding section.

2. The insulated beverage holder of claim 1 wherein the first container surrounding section is a sleeve for receiving a lower portion of the beverage container and the second container surrounding section is a lid for receiving an upper portion of the container.

3. The insulated beverage holder of claim 2 wherein the sleeve is movable to an operative position outside the lid for receiving the beverage container and further comprising means mounting the lid, in the operative position of the sleeve, for movement between a first protective position coaxial with the sleeve for covering the container and a second drinking position away from the sleeve where an upper portion of the container is accessible.

4. The insulated beverage holder of claim 3 further comprising means for holding the lid in the second drinking position.

5. The insulated beverage holder of claim 4 wherein the central portion of the lid comprises a flat section, the lid further comprising a lip, the lid mounting means comprising a flexible flap attached to the lid and to the sleeve, the means holding the lid in the second drinking position comprising a first fastener on the flap and a second fastener on the lid.

6. The insulated beverage holder of claim 5 wherein the flap comprises a tab having the first fastener thereon and wherein the means holding the lid in the second drinking position comprises a third fastener on the tab and a fourth fastener on the flap, the tab being attachable to the flap and the lid being attachable to the tab for at least partially immobilizing the lid in the second drinking position of the lid.

7. The insulated beverage holder of claim 1 wherein the lid comprises a lip and a flap for closing the lip in the stowed position.

8. The insulated beverage holder of claim 7 wherein the central portion of the sleeve comprises a bottom providing an insulated support for the container, the flap and bottom being generally parallel in the stowed position.

9. The insulated beverage holder of claim 7 wherein the lip is of a predetermined height and the insulated beverage holder is of substantially the same predetermined height in the stowed position.

10. The insulated beverage holder of claim 7 further comprising means securing the flap over the lid lip in the stowed position.

11. The insulated beverage holder of claim 2 wherein the lid comprises a flap mounting the lid for movement toward and away from the sleeve and means for securing the flap in the stowed position for constraining the sleeve inside the lid.

12. The insulated beverage holder of claim 11 wherein the securing means comprises a tab on the flap having a first fastener thereon and the lid lip provides a second fastener mating with the first fastener.

13. The insulated beverage holder of claim 12 wherein the central portion of the lid comprises a flat section, the lid further comprising a lip and a flap for closing the lip in the stowed position, and means holding the lid in a position away from the sleeve comprising a third fastener on the flap and a tab carried by the flap having a fourth fastener thereon for mating with the third fastener.

14. The insulated beverage holder of claim 1 wherein the lid comprises a lip of a predetermined height and the insulated beverage holder is of the same predetermined height in the stowed position.

15. The insulated beverage holder of claim 2 wherein the thermally insulating material is a foam.

16. The insulated beverage holder of claim 2 wherein the sleeve is cylindrical in an operative position to receive a beverage container having a cylindrical side wall.

17. The insulated beverage holder of claim 2 wherein the sleeve comprises a bottom wall.

18. An insulated beverage holder comprising an open top sleeve made of a thermally insulating material for receiving a beverage container, a lid, means mounting the lid on the sleeve for movement between a first position for receiving an upper portion of the container and a second offset position whereby an individual may drink from the container without interference from the lid, the lid mounting means comprises a resilient flap interconnecting the lid and sleeve, and means selectively connecting sections of the flap and lid together for selectively constraining the lid against movement from the second position toward the first position, the means selectively constraining the lid against movement comprises connectors on the lid and on the flap.

19. An insulated beverage holder comprising an open top sleeve made of a thermally insulating material for receiving a beverage container wherein the sleeve has a central section and a side wall extending perpendicularly from the central section, and a lid for receiving an upper portion of the container wherein the lid has a central section and a skirt extending parallel to the side wall, the sleeve being collapsed in a stowed position inside the lid.

* * * * *